United States Patent [19]

Wulfers

[11] 4,306,985

[45] Dec. 22, 1981

[54] STABILIZATION OF HYDROCRACKED OILS WITH CERTAIN NITROGEN CONTAINING AROMATIC COMPONENTS AND PHENOLIC COMPONENTS

[75] Inventor: Thomas F. Wulfers, Hazel Crest, Ill.

[73] Assignee: Atlantic Richfield Company, Philadelphia, Pa.

[21] Appl. No.: 164,640

[22] Filed: Jun. 30, 1980

Related U.S. Application Data

[63] Continuation-in-part of Ser. No. 11,839, Feb. 14, 1979, Pat. No. 4,234,434.

[51] Int. Cl.[3] ..... C10M 1/34

[52] U.S. Cl. ..... 252/51.5 R; 252/403

[58] Field of Search ..... 252/51.5 R, 403

[56] References Cited

U.S. PATENT DOCUMENTS

| | | | |
|---|---|---|---|
| 2,529,189 | 11/1950 | Rocchini et al. | 252/51.5 R X |
| 2,658,925 | 11/1953 | Cenker et al. | 252/401 X |
| 2,809,164 | 10/1957 | Pruett | 252/51.5 R |
| 2,824,895 | 2/1958 | Luvisi | 252/401 X |
| 3,402,201 | 9/1968 | Schmerling | 252/401 X |
| 3,642,610 | 2/1972 | Divijak, Jr. et al. | 208/58 X |
| 3,900,410 | 8/1975 | Malec | 252/51.5 R |
| 4,011,057 | 3/1977 | Sayers | 252/403 X |
| 4,036,770 | 7/1977 | Espenscheid et al. | 252/51.5 R |

*Primary Examiner*—Andrew Metz

*Attorney, Agent, or Firm*—Frank J. Uxa

[57] ABSTRACT

Hydrocracked lubricating oils are effectively stabilized against deterioration caused by light by the inclusion of at least one of each of certain nitrogen-containing aromatic components and phenolic components. The combination of such components, e.g., dialkyl anilines and alkyl substituted phenols, provide outstanding inhibition to sunlight deterioration.

21 Claims, No Drawings

STABILIZATION OF HYDROCRACKED OILS WITH CERTAIN NITROGEN CONTAINING AROMATIC COMPONENTS AND PHENOLIC COMPONENTS

This application is a continuation-in-part of application Ser. No. 11,839, filed Feb. 14, 1979, now U.S. Pat. No. 4,234,434

The invention relates to a method of stabilizing a hydrocracked oil. More particularly, it relates to stabilizing such oils against light and/or air deterioration by adding thereto at least one of certain nitrogen-containing aromatic components.

It is known that oils in general will degrade slowly in the presence of light and/or air. Oils such as the economically valuable hydrocracked lubricating oils used in this invention, degrade in light, especially in the presence of air. Since the hydrocracked oils are valuable, there has been considerable effort to find ways to prevent their breakdown due to light and air.

U.S. Pat. No. 4,036,770 teaches a method for stabilizing hydrocracked oils which involves adding nitro-containing aromatic amine components. Such components are relatively expensive and therefore may add significantly to the cost of the hydrocracked oils. Also, such components may impart a less than desirable color to the final product.

U.S. Pat. No. 4,101,430 teaches that oxidative degradation of lubricant compositions containing certain organo sulfur-containing nickel complexes is inhibited.

One object of the present invention is to provide an improved method for stabilizing hydrocracked oils against the deteriorating effects of light.

Another object of the invention is to provide an improved composition of matter involving a hydrocracked oil which has improved inhibition against deterioration by light. Other objects and advantages of the present invention will become apparent hereinafter.

An improved hydrocracked oil composition has now been discovered. This composition comprises a major amount, preferably at least about 70%, by weight of a hydrocracked lubricating oil, a minor amount of weight of at least one added nitrogen-containing aromatic component having a structure:

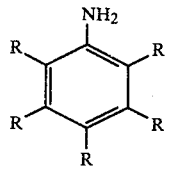

wherein each R is selected from the group consisting of H and substantially aliphatic monovalent hydrocarbonaceous radicals containing 1 to about 24, preferably 1 to about 14 and more preferably 1 to about 10, carbon atoms, such that one R is, preferably two (2) R's are, independently selected from the group consisting of such substantially aliphatic monovalent hydrocarbonaceous radicals, and a minor amount by weight of at least one added phenolic component selected from the group consisting of:

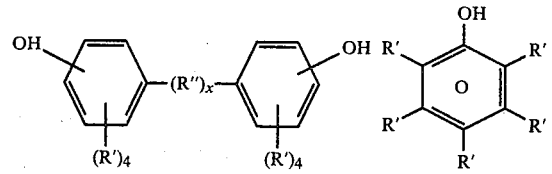

and mixtures thereof, wherein each R' is independently selected from the group consisting of H and monovalent substantially hydrocarbonaceous radicals containing 1 to about 24, preferably 1 to about 14 and more preferably 1 to about 10, carbon atoms, provided that at least one and preferably two or three, of the R's associated with each phenyl ring is a monovalent substantially hydrocarbonaceous radical, R'' is a divalent substantially hydrocarbonaceous radical containing from 1 to about 24, preferably 1 to about 10, carbon atoms; and x is an interger having a value of zero or 1. It is preferred that at least one of the positions ortho to each of the hydroxy radicals of the phenolic components be occupied by a substantially hydrocarbonaceous radical. With regard to the diphenyl embodiment of the presently useful phenolic component, it is preferred that the hydroxy groups be situated para to each other, i.e., 4,4'-bis(dihydroxy diphenyl).

It is preferred that each hydrocarbonaceous radical be substantially saturated.

In a preferred embodiment, the added nitrogen-containing aromatic component comprises about 0.05% to about 2.0%, more preferably, about 0.1% to about 1.0%, by weight of the total composition. The added phenolic component preferably comprises about 0.005% to about 2.0%, more preferably about 0.01% to about 1.0% and still more preferably about 0.01% to about 0.5%, by weight of the total composition.

The term "hydrocracked lubricating oil" means an oil, preferably a mineral oil, of lubricating viscosity which is derived from a lubricating oil produced by contacting a hydrocarbon feedstock with hydrogen, preferably in the presence of catalyst effective to promote hydrocracking, at hydrocarbon hydrocracking conditions to produce an oil of lubricating viscosity having an increased viscosity index relative to the viscosity index of the hydrocarbon feedstock. In addition, the hydrocracking lubricating oil may be subjected to additional processing, e.g., further contacting with hydrogen-again preferably in the presence of an effective catalyst-, other purifying procedures and the like, to further improve the quality, e.g., color, of the hydrocracked lubricating oil. For example, hydrocracked lubricating oils useful in the present invention may be obtained by the processes disclosed in U.S. Patent 3,642,610, the specification of which is hereby incorporated by reference herein.

Typical examples of the substantially aliphatic monovalent hydrocarbonaceous radicals from which R may be selected includes alkyl such as methyl, ethyl, propyl, butyl, pentyl, hexyl (including cyclohexyl), octyl, decyl, dodecyl, hexadecyl, stearyl and the like; and alkenyl such as ethylenyl, propenyl, butenyl, oleyl, linoleyl and the like. As noted above, it is preferred that such hydrocarbonaceous radicals be substantially saturated.

Typical examples of the substantially monovalent hydrocarbonaceous radicals from which R' may be selected includes alkyl, such as methyl, ethyl, propyl, butyl, pentyl, hexyl (including cyclohexyl), octyl, decyl, dodecyl, hexadecyl, stearyl and the like; alkenyl such as ethylenyl, propenyl, butenyl, oleyl, linoleyl and the like; aryl, such as phenyl, benzyl and the like; alkaryl such as methyl phenyl, ethyl phenyl, butyl phenyl, octyl phenyl, stearyl phenyl and the like; alkenaryl such as ethylenyl phenyl, octenyl phenyl, oleyl phenyl and the like; aralkyl such as phenyl ethyl, phenyl octyl, phenyl stearyl and the like; and aralkenyl such as phenyl ethylenyl, phenyl butenyl, phenyl octenyl, pheny oleyl and the like. As noted above, it is preferred that such hydrocarbonaceous radicals be substantially saturated.

Typical examples of the substantially divalent hydrocarbonaceous radicals from which R″ may be selected include alkylene, such as methylene, ethylene, propylene, octylene and the like; alkenylene such as ethylenylene, propenylene, octenylene and the like; divalent aromatic radicals such as pehnylene, benzylene, alkyl phenylene, alkenyl phenylene, aralkylene, aralkenylene and the like. It is preferred that R″ be substantially aliphatic and, more preferably be methylene.

By "substantially hydrocarbonaceous" radical is meant those radicals which are composed mainly of hydrogen and carbon, and include such radicals which contain, in addition, minor amounts of substituents, such as chlorine, bromine, sulfur, nitrogen and the like, which do not substantially affect their hydrocarbon character. Preferably, such substantially hydrocarbonaceous radicals include only carbon and hydrogen atoms.

The presently useful nitrogen-containing aromatic compounds and phenolic compounds may be produced using procedures well known in the art.

The following examples illustrate more clearly the compositions and methods of the present invention. However, these illustrations are not to be interpreted as specific limitations on this invention.

EXAMPLES

These examples illustrate certain of the advantages of the present invention.

A commercially available hydrocracked oil of lubricating viscosity was selected for testing. This hydrocracked oil had the following properties.

| | |
|---|---|
| Initial Boiling Point, °F. | >600 |
| Viscosity, SUS at 100° F. | 156.0 |
| Viscosity Index | 106 |

This oil was derived using well known lube oil hydrocracking processes.

This hydrocracked oil was blended with the following materials to form the following composition.

| Composition | Hydrodracked Oil | Wt. % Dimethyl Analine | DBPC(1) | Phenolic Component(2) |
|---|---|---|---|---|
| 1 | 100 | 0 | 0 | 0 |
| 2 | 99.6 | 0 | 0.4 | 0 |
| 3 | 99.6 | 0.4 | 0 | 0 |
| 4 | 99.6 | 0.2 | 0.2 | 0 |
| 5 | 99.6 | 0 | 0 | 0.4 |
| 6 | 99.6 | 0.4 | 0 | 0 |

-continued

| Composition | Hydrodracked Oil | Wt. % Dimethyl Analine | DBPC(1) | Phenolic Component(2) |
|---|---|---|---|---|
| 7 | 99.6 | 0.2 | 0 | 0.2 |

(1)has the structure:

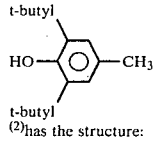

(2)has the structure:

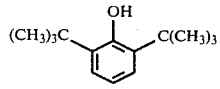

2,6-di-tert-butylphenol

In order to determine the susceptibility of the oil and blends to light deterioration, 10 gram samples were placed in 250 ml. beakers and exposed to two (2) 275 watt U.V. sunlamps at seven (7) inches on a rotating table for a period of fifteen (15) hours. After the fifteen (15) hour exposure period, each of the samples was processed to determine the amount of solids (sludge) formation. The following results were obtained:

| Composition | Solids After Exposure mg./gm. oil |
|---|---|
| 1 | — |
| 2 | 0.27 |
| 3 | 0.54 |
| 4 | 0.17 |
| 1 | — |
| 5 | 0.86 |
| 6 | 0.54 |
| 7 | 0.36 |

These results indicate that hydrocracked lubricating oil alone is susceptible to deterioration by sunlight.

The combination of nitrogen-containing aromatic components and phenolic component, as set forth in the present invention, are shown to provide substantial and unexpected inhibition of deterioration of hydrocracked oil by sunlight relative to, for example, the inhibition obtained using each of the components above.

While this invention has been described with respect to various specific examples and embodiments, it is to be understood that the invention is not limited thereto and that it can be variously practiced within the scope of the following claims:

The embodiments of the invention in which an exclusive property or privilege is claimed are defined as follows:

1. A composition of matter comprising a major amount by weight of a hydrocracked lubricating oil, a minor amount by weight of at least one added nitrogen-containing aromatic component having a structure:

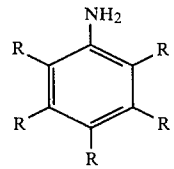

wherein each R is independently selected from the group consisting of H and substantially aliphatic monovalent hydrocarbonaceous radicals containing 1 to about 24 carbom atoms such that at least one R is a substantially aliphatic monovalent hydrocarbonaceous radical, and a minor amount by weight of at least one added phenolic component selected from the group consisting of:

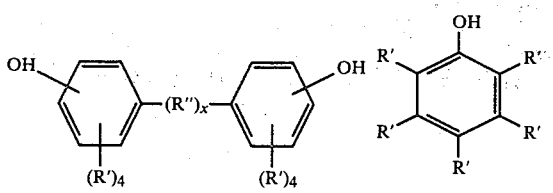

and mixtures thereof wherein each R′ is independently selected from the group consisting of H and monovalent substantially hydrocarbonaceous radicals containing 1 to about 24 carbon atoms, provided that at least one of said R′s associated with each phenyl ring is a monovalent substantially hydrocarbonaceous radical, R″ is a divalent substantially hydrocarbonaceous radical containing from 1 to about 24 carbon atoms, and x is an integer having a value of zero or 1, said nitrogen-containing aromatic component and said phenolic component being present in an amount effective to reduce the susceptibility to sunlight deterioration of said hydrocracked oil.

2. The composition of claim 1 wherein said hydrocracked lubricating oil comprises at least about 70% by weight of said composition.

3. The composition of claim 2 wherein 2 of said R′s are independently selected from the group consisting of substantially aliphatic hydrocarbonaceous radicals and two or three of said R′s associated with each of said phenyl rings is a monovalent substantially hydrocarbonaceous radical.

4. The composition of claim 3 wherein said added nitrogen-containing aromatic component comprises about 0.05% to about 2.0% by weight of said composition and said added phenolic component comprises about 0.005% to about 2.0% by weight of said composition.

5. The composition of claim 4 wherein said added phenolic component comprises about 0.01% to about 1.0% by weight of said composition.

6. The composition of claim 2 wherein said added nitrogen-containing aromatic component comprises about 0.1% to about 1.0% by weight of said composition and said added phenolic component comprises about 0.01% to about 0.5% by weight of said composition.

7. The composition of claim 3 wherein said added nitrogen-containing aromatic component comprises about 0.1% to about 1.0% by weight of said composition and said added phenolic component comprises about 0.01% to about 0.5% by weight of said composition.

8. The composition of claim 7 wherein said substantially aliphatic monovalent hydrocarbonaceous radicals contain 1 to about 14 carbon atoms.

9. The composition of claim 7 wherein said substantially aliphatic monovalent hydrocarbonaceous radicals are substantially saturated and contain 1 to about 10 carbon atoms.

10. The composition of claim 2 wherein at least one position ortho to each hydroxy group of said phenolic component is occupied by a monovalent substantially hydrocarbonaceous radical.

11. The composition of claim 3 wherein the hydroxy groups of the diphenyl embodiment of said phenolic components are located at mutually spaced positions.

12. A method for inhibiting a hydrocracked lubricating oil from deterioration caused by sunlight comprising combining with said oil a minor, effective amount by weight of at least one added nitrogen-containing aromatic component having a structure:

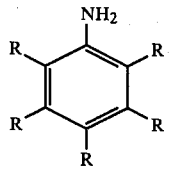

wherein each R is independently selected from the group consisting of H and substantially aliphatic monovalent hydrocarbonaceous radicals containing 1 to about 24 carbon atoms such that at least one R is a substantially aliphatic monovalent hydrocarbonaceous radical, and a minor effective amount by weight of at least one added phenolic component selected from the group consisting of:

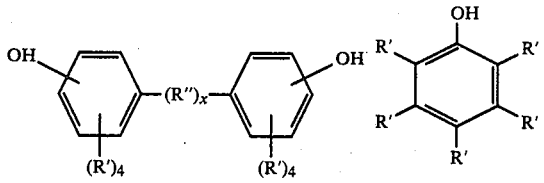

and mixtures thereof wherein each R′ is independently selected from the group consisting of H and monovalent substantially hydrocarbonaceous radicals containing 1 to about 24 carbon atoms, provided that at least one of said R′s associated with each phenyl ring is a monovalent substantially hydrocarbonaceous radical, R″ is a divalent substantially hydrocarbonaceous radical containing from 1 to about 24 carbon atoms, and x is an integer having a value of zero or 1, said nitrogen-containing aromatic component and said phenolic component being present in an amount effective to reduce the susceptibility to sunlight deterioration of said hydrocracked oil.

13. A method of claim 12 wherein said hydrocracked lubricating oil comprises at least about 70% by weight of said composition.

14. The method of claim 13 wherein two of said R′s are independently selected from the group consisting of substantially aliphatic hydrocarbonaceous radicals and two or three of said R′s associated with each of said phenyl rings is a monovalent substantially hydrocarbonaceous radical.

15. The method of claim 14 wherein said added nitrogen-containing aromatic component comprises about 0.05% to about 2.0% by weight of said composition and said added phenolic component comprises about 0.005% to about 2.0% by weight of said composition.

16. The method of claim 15 wherein said added phenolic component comprises about 0.01% to about 1.0% by weight of said component combination.

17. The method of claim 13 wherein said added nitrogen-containing aromatic component comprises about 0.1% to about 1.0% by weight of said composition and said added phenolic component comprises about 0.01% to about 0.5% by weight of said component combination.

18. The method of claim 14 wherein said added nitrogen-containing aromatic component comprises about 0.1% to about 1.0% by weight of said composition and said added phenolic component comprises about 0.01% to about 0.5% by weight of said component combination.

19. The method of claim 18 wherein said substantially aliphatic monovalent hydrocarbonaceous radicals contain 1 to about 14 carbon atoms.

20. The method of claim 13 wherein at least one position ortho to each hydroxy group of said phenolic component is occupied by a monovalent substantially hydrocarbonaceous radical.

21. The method of claim 14 wherein the hydroxy groups of the diphenyl embodiment of said phenolic components are located at mutually spaced positions.

* * * * *